US008401452B2

(12) United States Patent
Amita et al.

(10) Patent No.: US 8,401,452 B2
(45) Date of Patent: Mar. 19, 2013

(54) FIXING DEVICE WITH GLOSS CONTROL UNIT AND IMAGE FORMING APPARATUS

(75) Inventors: Akiyasu Amita, Yokohama (JP); Hiroyuki Kunii, Yokohama (JP); Shuntaroh Tamaki, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 246 days.

(21) Appl. No.: 12/878,686

(22) Filed: Sep. 9, 2010

(65) Prior Publication Data

US 2011/0064494 A1 Mar. 17, 2011

(30) Foreign Application Priority Data

Sep. 15, 2009 (JP) ..... 2009-212694
Oct. 29, 2009 (JP) ..... 2009-249280

(51) Int. Cl.
*G03G 15/20* (2006.01)

(52) U.S. Cl. ..... 399/341

(58) Field of Classification Search ..... 399/341, 399/329

See application file for complete search history.

(56) References Cited

U.S. PATENT DOCUMENTS

| | | | | |
|---|---|---|---|---|
| 5,099,288 | A * | 3/1992 | Britto et al. | 399/320 |
| 6,687,483 | B2 * | 2/2004 | Chen et al. | 399/341 |
| 6,795,661 | B2 * | 9/2004 | Kanesawa et al. | 399/69 |
| 6,813,464 | B2 | 11/2004 | Amita et al. | |
| 6,957,036 | B2 | 10/2005 | Kikuchi et al. | |
| 7,010,257 | B2 | 3/2006 | Someya et al. | |
| 7,031,648 | B2 | 4/2006 | Takashi et al. | |
| 7,127,202 | B2 | 10/2006 | Fujita et al. | |
| 7,139,520 | B2 | 11/2006 | Echigo et al. | |
| 7,177,580 | B2 | 2/2007 | Nakafuji et al. | |
| 7,209,675 | B2 | 4/2007 | Matsusaka et al. | |
| 7,233,762 | B2 | 6/2007 | Kunii et al. | |
| 7,239,821 | B2 | 7/2007 | Matsusaka et al. | |
| 7,254,362 | B2 | 8/2007 | Kikuchi et al. | |
| 7,269,384 | B2 | 9/2007 | Someya et al. | |
| 7,299,003 | B2 | 11/2007 | Kurotaka et al. | |
| 7,333,760 | B2 | 2/2008 | Baba et al. | |
| 7,343,113 | B2 | 3/2008 | Matsusaka et al. | |
| 7,359,666 | B2 | 4/2008 | Takashi et al. | |

(Continued)

FOREIGN PATENT DOCUMENTS

| | | |
|---|---|---|
| JP | 63-6584 | 1/1988 |
| JP | 63-192068 | 8/1988 |

(Continued)

OTHER PUBLICATIONS

U.S. Appl. No. 12/719,326, filed Mar. 8, 2010, Hiroyuki Kunii.

*Primary Examiner* — Quana M Grainger
(74) *Attorney, Agent, or Firm* — Oblon, Spivak, McClelland, Maier & Neustadt, L.L.P.

(57) ABSTRACT

A fixing device including a fixing unit that fixes a toner image on a recording material by application of heat and pressure, and a glossing unit that controls a gloss of the toner image fixed on the recording material. The glossing unit includes a heating roller, an endless belt stretched taut over multiple rollers including the heating roller, a pressing roller pressed against the heating roller with the endless belt therebetween to form a nip therebetween, and a separating member that separates the recording material from the endless belt downstream from the nip. The multiple rollers are positioned to maintain the recording material in contact with the endless belt for a predetermined distance downstream from the nip. The separating member is movable along the endless belt downstream from the nip, to control a length of contact between the recording material and the endless belt.

11 Claims, 7 Drawing Sheets

U.S. PATENT DOCUMENTS

| | | | |
|---|---|---|---|
| 7,369,803 | B2 | 5/2008 | Echigo et al. |
| 7,433,641 | B2 | 10/2008 | Kikuchi et al. |
| 7,526,242 | B2 | 4/2009 | Takagaki et al. |
| 7,570,911 | B2 | 8/2009 | Nakafuji et al. |
| 7,583,922 | B2 | 9/2009 | Takashi et al. |
| 7,609,988 | B2 | 10/2009 | Kishi et al. |
| 7,664,410 | B2 | 2/2010 | Takagi |
| 7,738,827 | B2 | 6/2010 | Someya et al. |
| 2005/0158075 | A1 | 7/2005 | Echigo et al. |
| 2006/0013624 | A1 | 1/2006 | Kurotaka et al. |
| 2006/0029411 | A1 | 2/2006 | Ishii et al. |
| 2007/0014600 | A1 | 1/2007 | Ishii et al. |
| 2008/0253789 | A1 | 10/2008 | Yoshinaga et al. |
| 2009/0169232 | A1 | 7/2009 | Kunii et al. |

FOREIGN PATENT DOCUMENTS

| | | | |
|---|---|---|---|
| JP | 1-265283 | | 10/1989 |
| JP | 2-162383 | | 6/1990 |
| JP | 4-31393 | | 5/1992 |
| JP | 7-50365 | | 5/1995 |
| JP | 09258592 | A * | 10/1997 |
| JP | 2003-167459 | | 6/2003 |
| JP | 2004-139040 | | 5/2004 |
| JP | 2004-167757 | | 6/2004 |
| JP | 2004-325934 | | 11/2004 |
| JP | 2007-108464 | | 4/2007 |
| JP | 2007-148430 | | 6/2007 |

* cited by examiner

FIXING DEVICE WITH GLOSS CONTROL UNIT AND IMAGE FORMING APPARATUS

CROSS-REFERENCE TO RELATED APPLICATIONS

The present patent application claims priority pursuant to 35 U.S.C. §119 from Japanese Patent Application Nos. 2009-212694 and 2009-249280, filed on Sep. 15, 2009 and Oct. 29, 2009, respectively, each of which is hereby incorporated by reference herein in its entirety.

BACKGROUND

1. Field of the Invention

The present invention relates to a fixing device that fixes a toner image on a recording material by application of heat and pressure. In addition, the present invention also relates to an image forming apparatus, such as a copier, a printer, or a multifunctional apparatus combining these functions, including the fixing device.

2. Description of the Background

An electrophotographic image forming apparatus generally includes a fixing device that fixes a toner image on a recording material by application of heat and pressure. Toner that composes the toner image is generally comprised of a resin fusible by heat.

FIG. 1 schematically illustrates a related-art fixing device including two rollers. A heating roller 101 and a pressing roller 103 form a nip therebetween. The heating roller 101 is driven to rotate clockwise in FIG. 1, and the pressing roller 103 rotates along rotation of the heating roller 101. The heating roller 101 incorporates a heat source 102 that heats the surface of the heating roller 101 above the softening point of toner in use.

An unfixed toner image formed on a recording material is fed to the nip between the heating roller 101 and the pressing roller 103, and receives heat and pressure from the heating roller 101 and the pressing roller 103. The toner image is softened and melted in the nip, and then cooled after passing through the nip, resulting in fixation of the toner image on the recording material.

However, the toner image thus fixed on the recording material by a fixing device having the configuration described above has a problem of low gloss. The reason for the low gloss is considered as follows.

At the exit of the nip between the heating roller 101 and the pressing roller 103, the sufficiently-melted toner image is contacting the smooth surface of the heating roller 101. Therefore, the melted toner image is expressing substantially the same gloss as the smooth surface of the heating roller 101 at the exit of the nip. Such a melted toner image having a smooth surface (i.e., a high gloss) then gradually roughens its surface as the toner image separates from the heating roller 101, due to a force of separation acting against a force of adhesion exerted between the toner image and the heating roller 101 and increase of aggregation force of toner particles along with temperature decrease. Consequently, the toner image having a roughened surface is cooled and fixed on the recording material, providing a lower gloss. Conventional fixing devices, including both roller-type and belt-type fixing devices, have such a problem of decrease in image gloss.

In view of this situation, various attempts have been made to increase gloss of a toner image fixed on a recording material.

For example, Japanese Patent Application Publication No. S63-192068 (JP-S63-192068-A) proposes a method of increasing image gloss by passing a toner image through a nip formed between a heating roller and a pressing roller twice or more.

JP-H01-256283-A proposes a method of increasing image gloss by providing two nips, the first nip and the second nip. A toner image can be selectively passed through either of the nips to control the resultant image gloss.

JP-S63-122666-A proposes a method of increasing image gloss by applying heat and pressure to a toner image while covering the toner image with a sheet having a smooth surface and separating the sheet from the recording material after cooling the toner image.

JP-H01-279277-A and JP-S63-6584-A each propose a method of increasing image gloss by laminating a toner image between a recording material and a transparent sheet.

JP-H02-162383-A proposes a method of increasing image gloss by contacting a fixing belt with a toner image on a recording material while heating the toner image by a heater provided on the opposite side of the fixing belt from its recording material contacting side, cooling the toner image while keeping the fixing belt contacting the toner image, and then separating the fixing belt from the toner image.

In a case in which a toner image is fixed on coated paper, generally having a relatively high gloss, the toner image preferably expresses a relatively high gloss similar to that of the coated paper, so that a natural image having uniform gloss throughout the image is produced. However, where a toner image expresses such a relatively high gloss even when fixing on a recording material having a relatively low gloss, the resulting image may be unnatural due to the disparity in glossiness between different parts of the image. For the above reasons, it is not always preferable that toner images have high gloss. In some cases, it is preferable that the toner images have low gloss, depending on the type of recording material in use and the type of toner image desired.

However, none of the above-described five related art references selectively control the resulting image gloss as described above.

Further, JP-2004-325934-A and JP-2004-167757-A each discloses a method of increasing image gloss without any additional material, such as a sheet or a laminate film. Specifically, the resulting image gloss is increased by contacting an endless belt with a melted toner image on a recording material while cooling the toner image, and separating the endless belt from the toner image. This method has a problem in that the toner image is likely to solidify while contacting the endless belt. The solidified toner image is difficult to separate from the endless belt, probably causing paper jam. Additionally, the disclosed mechanism of controlling the resulting image gloss by adjusting the length of contact between the endless belt and the recording material by changing the positions of multiple rollers stretching the endless belt has the added disadvantage of making the fixing device bigger.

FIG. 2 schematically illustrates a related-art fixing device having a configuration as described above.

The fixing device illustrated in FIG. 2 has a mechanism for increasing image gloss. Specifically, the fixing device includes a fixing unit 10 that fixes a toner image on a recording material by application of heat and pressure, and a separate glossing unit 20 located downstream from the fixing unit 10 that increases gloss of the toner image fixed on the recording material.

The fixing unit 10 has a similar configuration as the related-art fixing device illustrated in FIG. 1. The fixing unit 10 includes a heating roller 11 and a pressing roller 12. The heating roller 11 and the pressing roller 12 form a fixing nip therebetween while rotating.

The heating roller 11 is driven to rotate clockwise in FIG. 2 by a driving mechanism, not shown. The pressing roller 12 is pressed against the heating roller 11 and is rotated counterclockwise in FIG. 2 along with rotation of the heating roller 11, while forming a fixing nip with the heating roller 11.

The heating roller 11 is constituted as a cylindrical metal core covered with a heat-resistant elastic layer comprised of a silicone rubber, etc. The heating roller 11 incorporates a halogen heater 13 that applies heat to toner images. Similarly, the pressing roller 12 is constituted as a cylindrical metal core covered with a heat-resistant elastic layer comprised of a silicone rubber, etc., incorporating a halogen heater 14.

Thermistors 15 and 16 are provided contacting the heating roller 11 and the pressing roller 12, respectively. The thermistors 15 and 16 detect the surface temperatures of the heating roller 11 and the pressing roller 12, respectively. A controller, not shown, turns the halogen heaters 13 and 14 on and off so that the heating roller 11 and the pressing roller 12 maintain predetermined temperatures.

The glossing unit 20 includes an endless belt 24 stretched taut with a heating roller 21, a supporting roller 26, and a separating roller 27. A pressing roller 22 is pressed against the heating roller 21 with the endless belt 24 therebetween. The heating roller 21 incorporates a halogen heater 23. A thermistor 25 is provided contacting the heating roller 21 to detect the surface temperature of the heating roller 21. A controller, not shown, turns the halogen heater 23 on/off so that the heating roller 21 maintains a predetermined temperature.

A cooler 28 is provided so as to face an inner circumferential surface of the endless belt 24. The cooler 28 cools the endless belt 24 and a recording material intimately contacting the endless belt 24, immediately downstream from where the pressing roller 22 is pressed against the heating roller 21. The cooler 28 may be a fan mechanism that cools the endless belt 24 by blowing air or a Peltier cooling mechanism that cools the endless belt 24 with a Peltier element that is a semiconductive element using the Peltier effect.

Operations of the fixing device illustrated in FIG. 2 are described below.

In the fixing unit 10, a recording material having an unfixed toner image thereon passes through the fixing nip formed between the heating roller 11 and the pressing roller 12, while the halogen heater 13 heats the heating roller 11 to a predetermined temperature and the pressing roller 12 presses the heating roller 11 with a predetermined pressure. Thus, the toner image is completely fixed on the recording material after passing through the fixing unit 10.

In the downstream glossing unit 20, the recording material passed through the fixing unit 10 then passes through the nip formed between the heating roller 21 and the pressing roller 22, so as to increase image gloss of the fixed toner image. Since the toner image is already completely fixed on the recording material in the fixing unit 10, the heating roller 21 applies only enough heat to level the surface of the toner image. For example, the heating roller 21 may be heated to a temperature between the temperature of the recording material at entry into the glossing unit 20 and that at immediately after discharge from the fixing unit 10. Alternatively, the heating roller 21 may be heated to a temperature between the softening temperature and the ½ flow starting temperature of the toner in use, for example, between 60° C. and 120° C. Thus, only the surface of the toner image, not the entire toner image, is softened and smoothened by contact with the endless belt 24 having a smooth surface, without degrading color tone of the entire toner image. The toner image thus given a high gloss is then conveyed a predetermined distance, and separated from the endless belt 24 by the curvature of the separating roller 27.

On the other hand, the cooler 28 cools the recording material as well as the endless belt 24, while the recording material is intimately contacting the endless belt 24. Therefore, the recording material has a lower temperature when separating from the endless belt 24 by the separation roller 27 than when passing through the nip formed between the heating roller 21 and the pressing roller 22. This means that the cooled and solidified toner image separates from the endless belt 24, which can maintain a high gloss of the toner image. It is to be noted that the cooler 28 is not necessary when the recording material can be cooled simply by intimate contact with the endless belt 24.

Generally, when gloss of a toner image is substantially the same as that of a recoding material on which the toner image is formed, we sense that the image is natural. There is a wide variety of recording materials, from low-gloss recording materials to high-gloss recording materials. For example, coated paper, widely used for brochures, has a glossiness of about 45%. When a toner image is formed on such a high-gloss coated paper, the toner image is required to express the same glossiness of about 45%. As another example, photographic images generally require a high glossiness of about 70 to 90%. In this specification, the glossiness (%) is measured with a gloss meter, the angle of incidence of which is set to 60°.

Gloss of a toner image varies depending on the temperature of the heating roller 11. The higher the temperature of the heating roller 11, the higher the gloss of the toner image. However, when the heating roller 11 is excessively heated with intent to increase the gloss of the toner image, it is likely that hot offset problem disadvantageously occurs. This is the reason why the glossing unit 20 is preferably provided immediately downstream from the fixing unit 10, rather than merely increasing the temperature of the heating roller 11.

The toner image has a glossiness of from 20 to 25% after passing through the glossing unit 20, even when the toner image is formed on a low-gloss paper having a glossiness of 5 to 10%. Such an inconsistency in glossiness between the toner image and the paper provides us with a sense of discomfort. The below-described fixing device solves such a problem.

FIG. 3 schematically illustrates another related-art fixing device which can control image gloss depending on the type of paper in use. The fixing device illustrated in FIG. 3 has the same configuration as that illustrated in FIG. 2 except that the position of the separating roller 27 is variable.

More specifically, the separating roller 27 is horizontally movable toward the heating roller 21 while keeping the recording material intimately contacting a lower surface of the endless belt 24, stretching between the heating roller 21 and the separating roller 27. The length of contact, in other words, the time of contact, between the recording material and the endless belt 24 is controllable by controlling the extent of movement of the separating roller 27. The supporting roller 26 is also movable along with movement of the separating roller 27 to keep the endless belt 24 stretched taut.

The fixing device illustrated in FIG. 3 operates in the same manner as that illustrated in FIG. 2 except that the separation roller 27 moves toward the heating roller 21 depending on the gloss of recording material in use, so as to control the time and/or length of contact between the recording material and the endless belt 24. Thus, the resulting image gloss is controllable. For example, when forming a photographic image on a high-gloss coated paper, the separating roller 27 is preferably positioned as indicated by dotted lines in FIG. 3, so that the time and/or length of contact between the recording material and the endless belt 24 becomes maximal. By contrast, when forming a much lower-gloss toner image, the separating roller 27 is preferably positioned as indicated by solid lines in FIG. 3, so that the time and/or length of contact between the recording material and the endless belt 24 are shortened. In this case, at the moment of separation of the toner image from the endless belt 24, the toner image has not been cooled as much as in a case in which the separating roller 27 is positioned as indicated by dotted lines in FIG. 3. Therefore, the toner image is likely show reduced gloss when separating from the endless belt 24.

However, the fixing device illustrated in FIG. 3 has a disadvantage in that horizontal movement of the separating roller 27 is limited due to the presence of the cooler 28, and therefore the time and/or length of contact between the recording material and the endless belt 24 are also limited. Such a fixing device does not satisfactorily meet the demand for controlling image gloss in accordance with divers recording materials. Additionally, providing space for moving the supporting roller 26 along with movement of the separating roller 27 hinders efforts to meet market demand for downsizing the fixing device.

SUMMARY

Exemplary aspects of the present invention are put forward in view of the above-described circumstances, and provide a novel fixing device and a novel image forming apparatus which can control gloss of a toner without any additional material, such as a sheet or a laminate film.

In one exemplary embodiment, a novel fixing device includes a fixing unit that fixes a toner image on a recording material by application of heat and pressure, and a glossing unit that controls a gloss of the toner image fixed on the recording material, provided downstream from the fixing unit relative to a direction of conveyance of the recording material. The glossing unit includes a heating roller, an endless belt stretched taut over multiple rollers including the heating roller, a pressing roller pressed against the heating roller with the endless belt therebetween to form a nip therebetween, and a separating member that separates the recording material from the endless belt downstream from the nip. The multiple rollers are positioned to maintain the recording material in contact with the endless belt for a predetermined distance downstream from the nip in the direction of conveyance of the recording material. The separating member is movable along the endless belt downstream from the nip in the direction of conveyance of the recording material, to control a length of contact between the recording material and the endless belt.

In another exemplary embodiment, a novel image forming apparatus includes an image forming unit that forms a toner image on a recording material, and the above fixing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
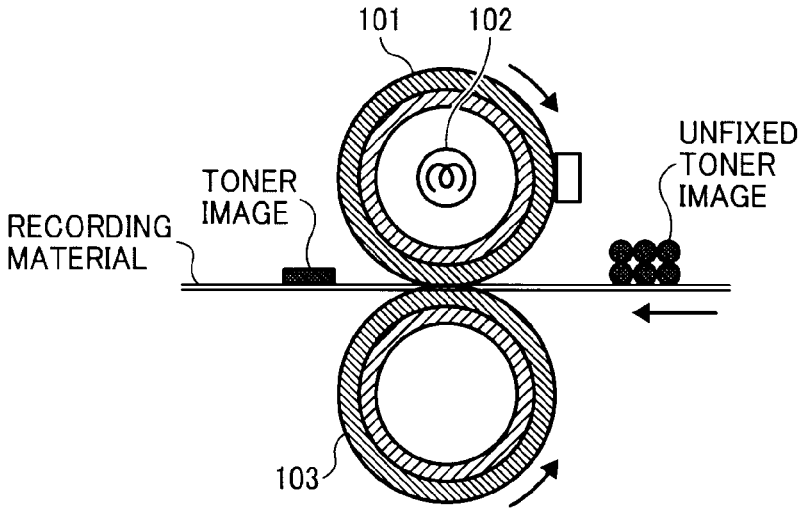
FIG. 1 RELATED ART
FIG. 1 schematically illustrates a related-art fixing device including two rollers.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 4:
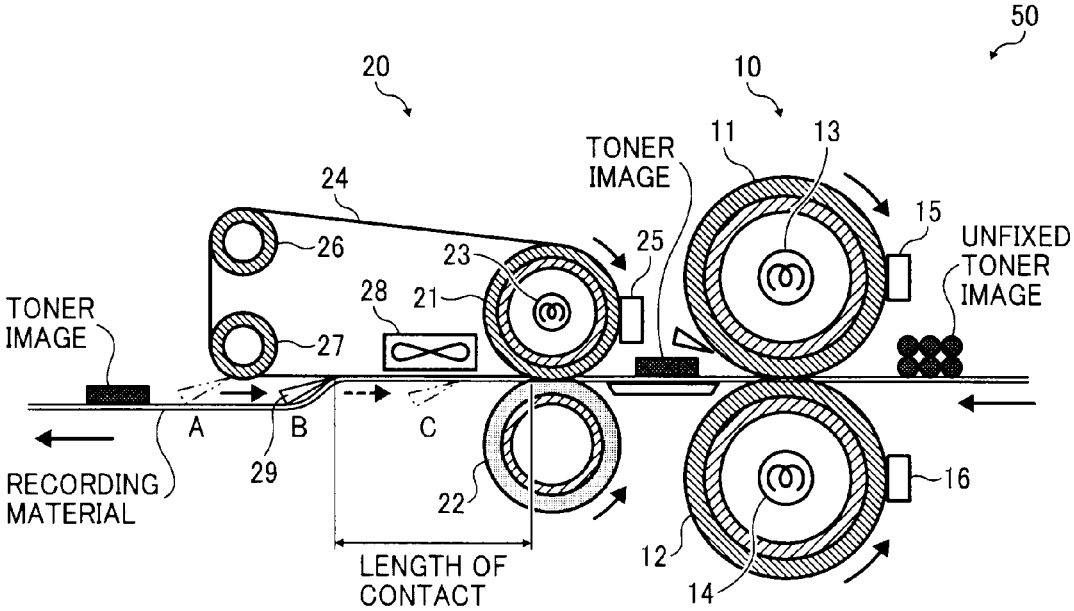
FIG. 4 schematically illustrates a first exemplary embodiment of a fixing device according to this specification.

FIG. 4 schematically illustrates a first exemplary embodiment of a fixing device according to this specification.

A fixing device 50 has a mechanism of increasing image gloss. Specifically, the fixing device 50 includes a fixing unit 10 that fixes a toner image on a recording material by application of heat and pressure, and a glossing unit 20 that increases gloss of the toner image fixed on the recording material. The fixing unit 10 has the same configuration as that illustrated in FIG. 2.

The glossing unit 20 includes a heating roller 21 incorporating a halogen heater 23, a supporting roller 26, a separating roller 27, an endless belt 24 stretched taut with the above rollers, a pressing roller 22 pressed against the heating roller 21 with the endless belt 24 therebetween, a thermistor 25 that detects the temperature of the heating roller 21 from above the endless belt 24, and a cooler 28 provided facing an inner circumferential surface of the endless belt 24 between the heating roller 21 and the separating roller 27. The endless belt 24 rotates along rotation of any of the rollers. The glossing unit 20 has the same configuration and operates in the same manner as that illustrated in FIG. 2.

The glossing unit 20 illustrated in FIG. 4 further includes a separating member 29 provided facing an outer circumferential surface (i.e., a recording-material-contacting side) of the endless belt 24. The separating member 29 is horizontally movable along the endless belt 24 between the separating roller 27 and the heating roller 21.

The separating member 29 comprises one or more claw-like platy members, and is provided so that the longitudinal direction thereof is coincident with the width direction of the endless belt 24. A leading edge of the separating member 29 is positioned proximally to a surface of the endless belt 24. The leading edge of the separating member 29 gets between the endless belt 24 and the recording material intimately contacting the endless belt 24, so that the recording material separates from the endless belt 24.

The separating member 29 is horizontally movable along the endless belt 24 between the separating roller 27 and the heating roller 21, so as to control the position of separation of the recording material from the endless belt 24. In other words, movement of the separating member 29 controls the distance and/or time of contact between the recording material and the endless belt 24. A guide member, not shown, is provided below the separating member 29 so that the recording material is introduced into a proper feed path after separating from the endless belt 24. The guide member is also horizontally movable along movement of the separating member 29.

Figure 5:
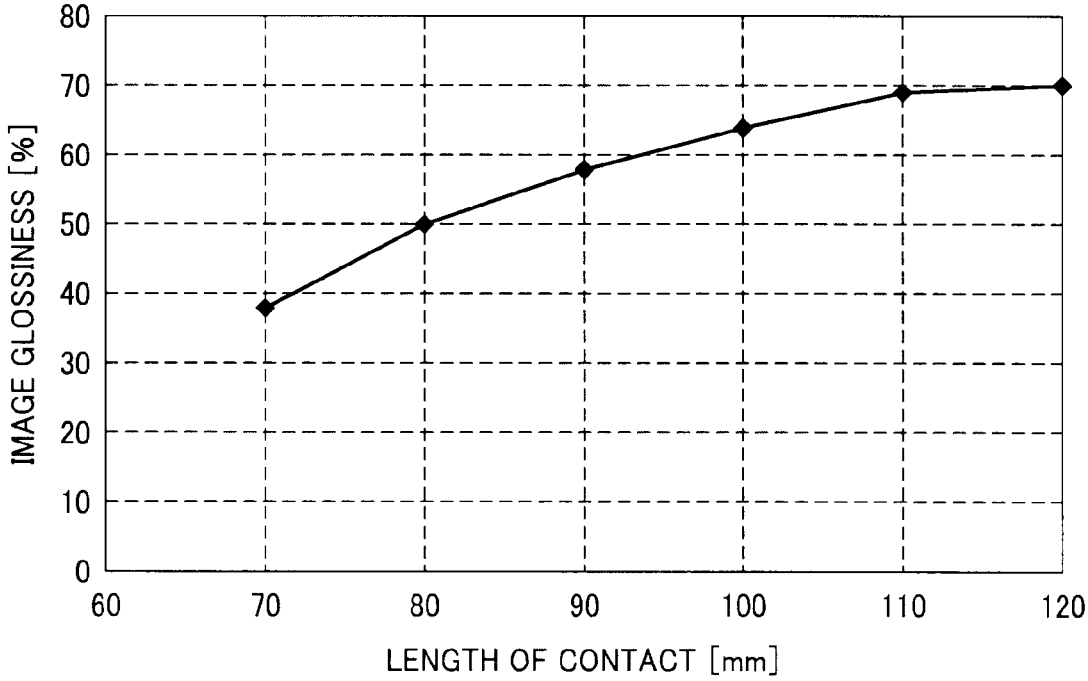
FIG. 5 shows a relation between the length of contact between a recording material and an endless belt, and the image glossiness in a fixing device according to this specification.

FIG. 5 shows a relation between the length of contact between the recording material and the endless belt 24, and the image glossiness in the fixing device 50. As is clear from FIG. 5 that as the length of contact becomes greater, the image glossiness becomes greater, and vice versa. Thus, the image gloss is controllable by controlling the length of contact between the recording material and the endless belt 24.

Figure 2:
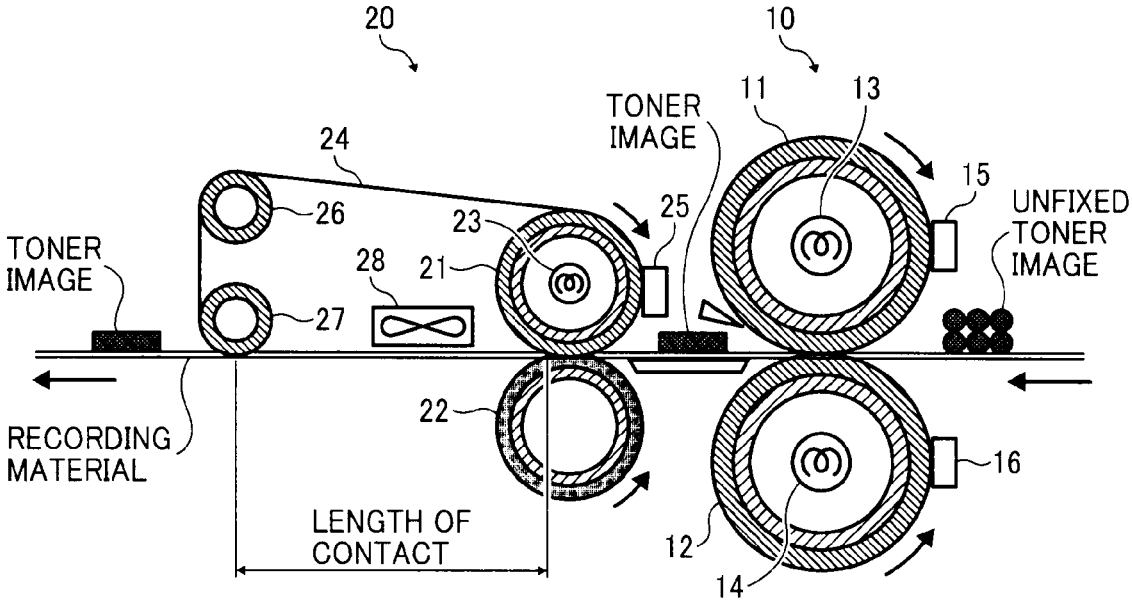
FIG. 2 RELATED ART
FIG. 2 schematically illustrates another related-art fixing device including a fixing unit and a glossing unit.
Figure 3:
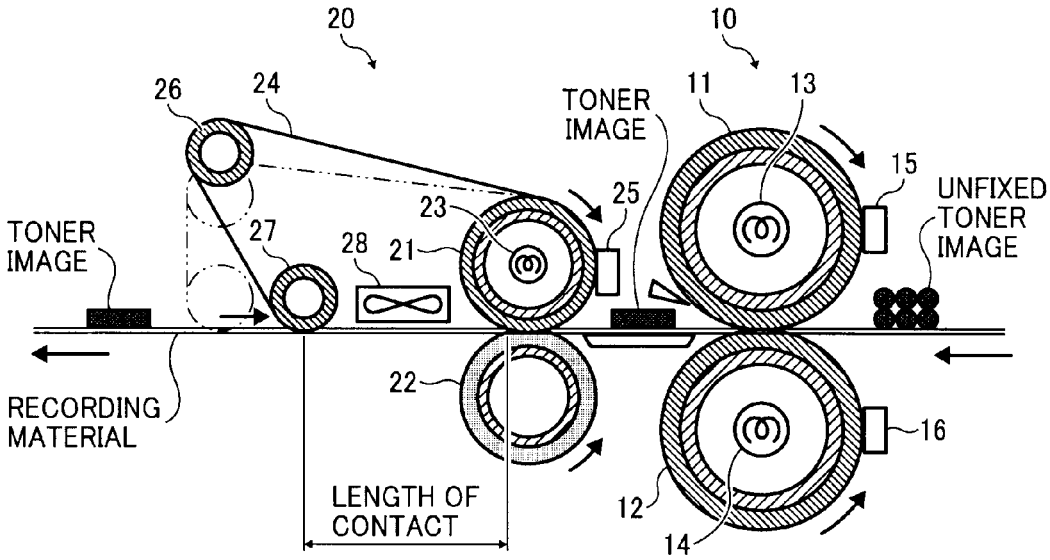
FIG. 3 RELATED ART
FIG. 3 schematically illustrates another related-art fixing device a fixing unit and a glossing unit, which can control image gloss.

The fixing device 50 has a similar configuration and operates in a similar manner to that illustrated in FIG. 2, but is different in that the recording material separates from the endless belt 24 by using the separating member 29, not the curvature of the separating roller 27. The separating member 29 is movable along the endless belt 24 between the separating roller 27 and the heating roller 21, so as to control the distance and/or time of contact between the recording material and the endless belt 24. Thus, the resulting image gloss is controllable depending on the type of recording material in use.

Operations of the fixing device 50 illustrated in FIG. 4 are described below.

First, operations in a high gloss mode are described.

In the first step (S11), a user inputs the type of recording material in use and the selected gloss mode into an image forming apparatus. Consider a case where the recording material in use is a coated paper having a glossiness of 45%, and a high gloss mode, which targets an image (e.g., a photographic image) having a glossiness of about 70%, is selected. In such a case, the separating member 29 is positioned near the separating roller 27, indicated as a position A in FIG. 4.

In the second step (S12), an unfixed toner image formed on the recording material is conveyed to the fixing nip formed between the heating roller 11 and the pressing roller 12 in the fixing unit 10, and the toner image is fixed on the recording material at a predetermined fixing temperature. The fixing temperature is predetermined based on the type (i.e., thickness) of recording material only for fixing the toner image on the recording material, not for controlling the image gloss. For example, when the predetermined fixing temperature is 160° C., the toner image has a glossiness of about 30% after passing through the fixing nip in the fixing unit 10.

In the third step (S13), the recording material having the fixed toner image thereon is then conveyed to the nip formed between the heating roller 21 and the pressing roller 22 in the glossing unit 20, and the toner image is heated and melted in the nip. For example, the temperature of the heating roller 21 is set to 120° C. After passing through the nip, the toner image still melting is conveyed while intimately contacting the endless belt 24.

In the fourth step (S14), the recording material is conveyed from the nip formed between the heating roller 21 and the pressing roller 22 toward the separating roller 27 (or the separating member 29 at the position A), while being cooled by the cooler 28. In the high gloss mode, the length of contact between the recording material and the endless belt 24 is set to maximum, for example, 120 mm, which is equal to the distance between the nip and the separating roller 27 (or the separating member 29 at the position A). Therefore, the toner image is consequently cooled to about 60° C. by the cooler 28 when passing by the separating roller 27. The toner image thus cooled and solidified separates from the endless belt 24, and results in a high-gloss image expressing a glossiness of about 70%.

Next, operations in a normal gloss mode are described.

In the first step (S21), a user inputs the type of recording material in use and the selected gloss mode into an image forming apparatus. Consider a case where the recording material in use is a coated paper having a glossiness of 45%, and a normal gloss mode, which targets an image having a glossiness of about 45%, is selected. In such a case, the separating member 29 is positioned at a position B in FIG. 4.

In the second step (S22), an unfixed toner image formed on the recording material is conveyed to the fixing nip formed between the heating roller 11 and the pressing roller 12 in the fixing unit 10, and the toner image is fixed on the recording material at a predetermined fixing temperature of 160° C. The toner image fixed on the recording material has a glossiness of about 30% after passing through the fixing nip in the fixing unit 10.

In the third step (S23), the recording material having the fixed toner image thereon is then conveyed to the nip formed between the heating roller 21 and the pressing roller 22 in the glossing unit 20, and the toner image is heated and melted in the nip. For example, the temperature of the heating roller 21 is set to 120° C. After passing through the nip, the toner image still melting is conveyed while intimately contacting the endless belt 24.

In the fourth step (S24), the recording material is conveyed from the nip formed between the heating roller 21 and the pressing roller 22 toward the separating member 29 at the position B, while being cooled by the cooler 28. In the normal gloss mode, the length of contact between the recording material and the endless belt 24 is set to, for example, 80 mm, which is equal to the distance between the nip and the separating member 29 at the position B. Therefore, the toner image is consequently cooled to about 90° C. by the cooler 28 when passing by the separating member 29 at the position B. The toner image thus cooled separates from the endless belt 24, and results in an image expressing a glossiness of about 45%.

Next, operations in a low gloss mode are described.

In the first step (S31), a user inputs the type of recording material in use and the selected gloss mode into an image forming apparatus. Consider a case where the recording material in use is a normal paper having a glossiness of 10% or a coated paper having a glossiness of 45%, and a low gloss mode, which targets a low-gloss image, is selected. In such a case, the separating member 29 is positioned at a position C in FIG. 4.

In the second step (S32), an unfixed toner image formed on the recording material is conveyed to the fixing nip formed between the heating roller 11 and the pressing roller 12 in the fixing unit 10, and the toner image is fixed on the recording material at a predetermined fixing temperature.

In the third step (S33), the recording material having the fixed toner image thereon is then conveyed to the nip formed between the heating roller 21 and the pressing roller 22 in the glossing unit 20, and the toner image is heated and melted in the nip. After passing through the nip, the toner image still melting is conveyed while intimately contacting the endless belt 24.

In the fourth step (S34), the recording material is conveyed from the nip formed between the heating roller 21 and the pressing roller 22 toward the separating member 29 at the position C, while being cooled by the cooler 28. In the low gloss mode, the length of contact between the recording material and the endless belt 24 is set equal to the distance between the nip and the separating member 29 at the position C. Therefore, the toner image is consequently cooled to some extent by the cooler 28 when passing by the separating member 29 at the position C. The toner image thus cooled separates from the endless belt 24, and results in a low-gloss image.

When glossing the toner image in the glossing unit 20, the surface temperature of the heating roller 21 and the nip pressure between the heating roller 21 and the pressing roller 22 may be controlled depending on the gloss mode selected. Thus, the toner image receives appropriate amounts of heat and pressure to level the surface thereof.

There may be a case where a toner image is formed on an A3-size recording material having a basis weight of 80 g/m$^2$ or less (e.g., a thin paper), which does not need glossing. It is likely that such a thin recording material gets wrinkled when subjected to deflection and stretching due to a difference in linear speed between the fixing unit 10 and the glossing unit 20. To solve such a problem, it is preferable that the pressing roller 22 is more detached from the heating roller 21 (or the endless belt 24). For example, the distance between the heating roller 21 (or the endless belt 24) and the pressing roller 22 is preferably 2 mm or less, within which the recording material can normally pass through the nip. Because the toner image may partially contact the endless belt 24 in such cases, the endless belt 24 preferably has a release layer comprised of a fluorine-containing resin on its surface, so as not to degrade the toner image.

As seen above, the fixing device 50 can control the length of contact and/or time between the recording material and the endless belt 24 by moving the separation member 29. Therefore, the fixing device 50 can control the resulting image gloss depending on the type of recording material in use. The separation member 29 requires only a small space for moving, which contributes to downsizing of the fixing device 50.

Figure 6A:
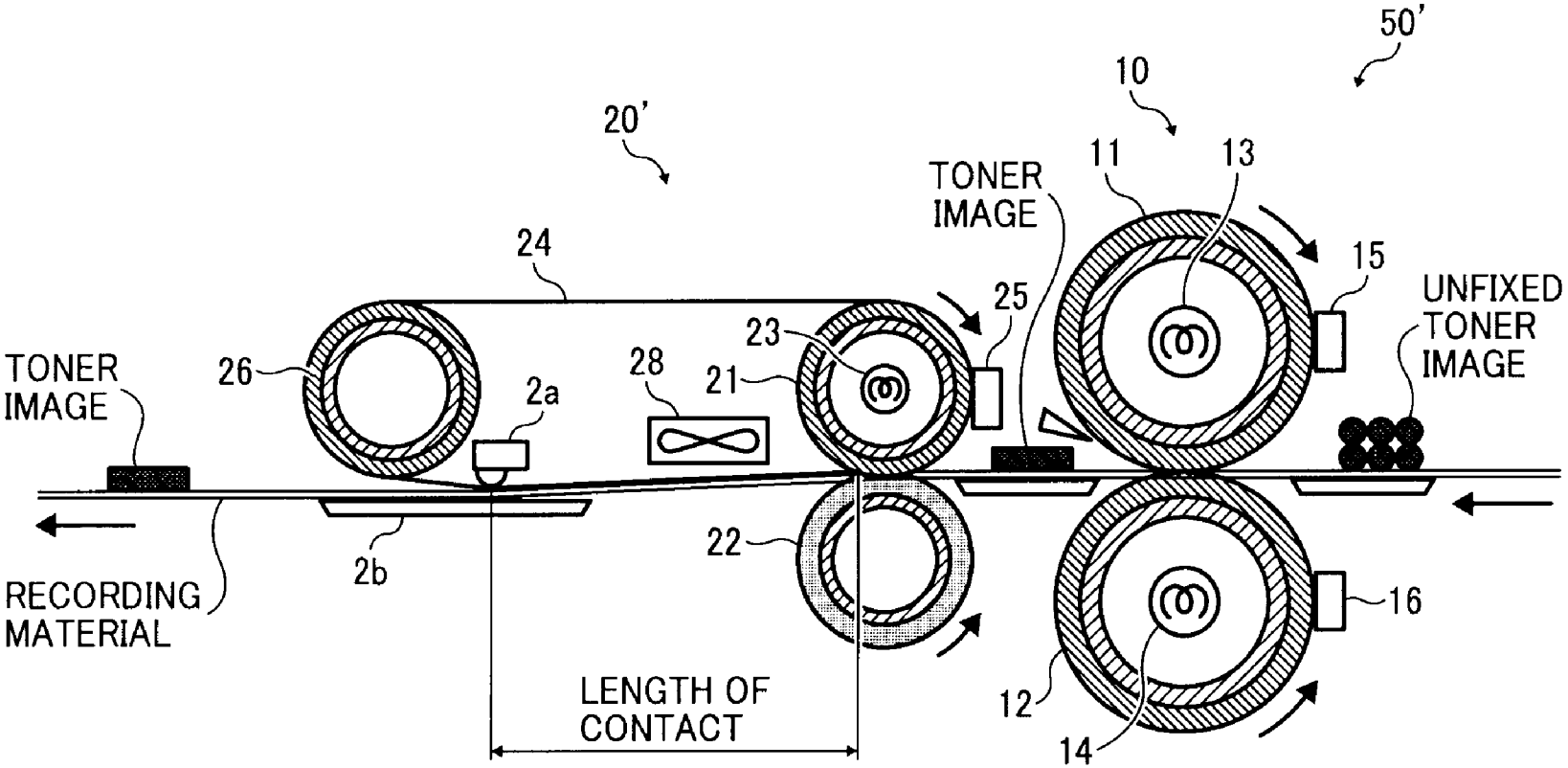
FIGS. 6A and 6B schematically illustrate a second exemplary embodiment of a fixing device according to this specification.
Figure 6B:
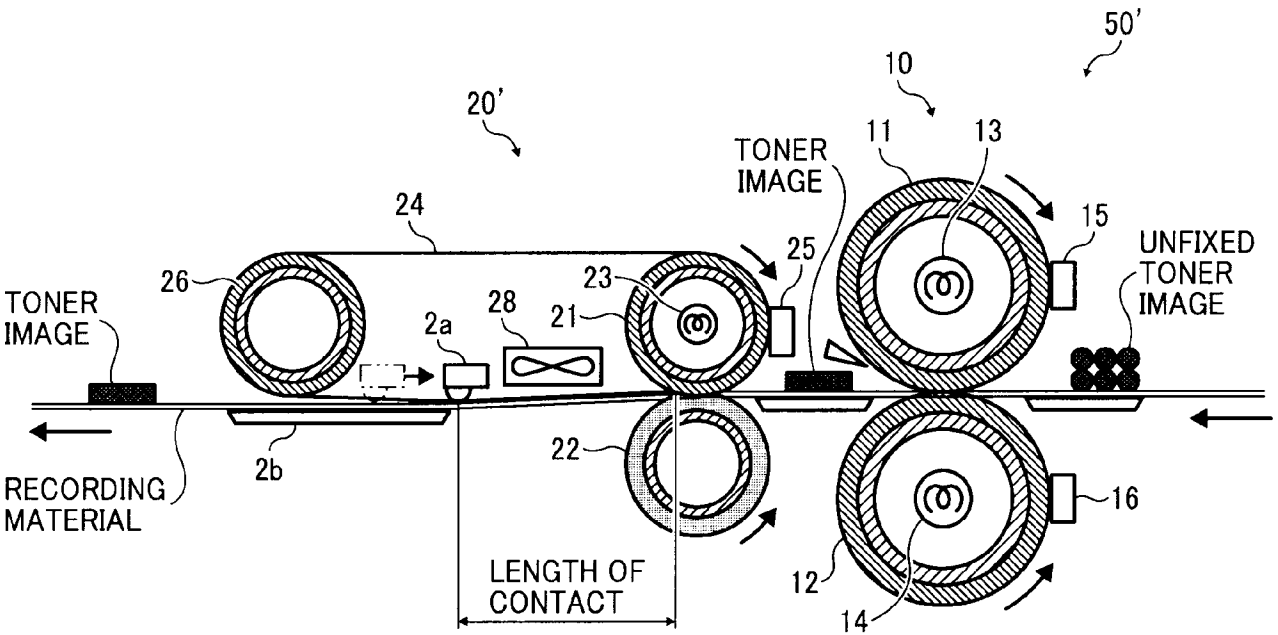

FIGS. 6A and 6B schematically illustrate a second exemplary embodiment of a fixing device according to this specification.

A fixing device 50' has a mechanism of increasing image gloss. Specifically, the fixing device 50' includes a fixing unit 10 that fixes a toner image on a recording material by application of heat, and a glossing unit 20' that increases gloss of the toner image fixed on the recording material. The fixing unit 10 has the same configuration as that illustrated in FIG. 2 or that illustrated in FIG. 4 in the first exemplary embodiment.

The glossing unit 20' includes a heating roller 21 incorporating a halogen heater 23, a supporting roller 26, an endless belt 24 stretched taut with the above rollers, a pressing roller 22 pressed against the heating roller 21 with the endless belt 24 therebetween, a thermistor 25 that detects the temperature of the heating roller 21 from above the endless belt 24, and a cooler 28 provided facing an inner circumferential surface of the endless belt 24 between the heating roller 21 and the supporting roller 26. The endless belt 24 rotates along rotation of any of the rollers. The glossing unit 20' has the same configuration and operates in the same manner as the glossing unit 20 illustrated in FIG. 2, except that the endless belt 24 is stretched taut with only the heating roller 21 and the supporting roller 26.

The glossing unit 20' further includes a separating member 2*a* provided facing an inner circumferential surface (i.e., an opposite side to a recording-material-contacting side) of the endless belt 24. The separating member 2*a* is horizontally movable along the endless belt 24 between the supporting roller 26 and the heating roller 21.

The separating member 2*a* presses an inner circumferential surface of the endless belt 24 so that a part of the endless belt 24 is pressed outward. The separating member 2*a* is a rod-shaped member comprised of a resin or a metal. A portion of the separating member 2*a* which slidably contacts the endless belt 24 is covered with a fluorine-containing resin, etc., so that the separating member 2*a* can smoothly slides on the endless belt 24.

The separating member 2*a* is provided so that the longitudinal direction thereof is coincident with the width direction of the endless belt 24, while contacting an inner circumferential surface of the endless belt 24. A part of the endless belt 24 is pressed outward by the separating member 2*a* so that the recording material separates from the endless belt 24. Referring to FIGS. 6A and 6B, the separating member 2*a* presses the endless belt 24 downward in the direction substantially vertical to the horizontal direction of conveyance of the recording material so that the recording material separates from the endless belt 24.

A portion of the separating member 2*a* which presses the endless belt 24 preferably has a shape tapered in the width direction of the endless belt 24.

Figure 7:
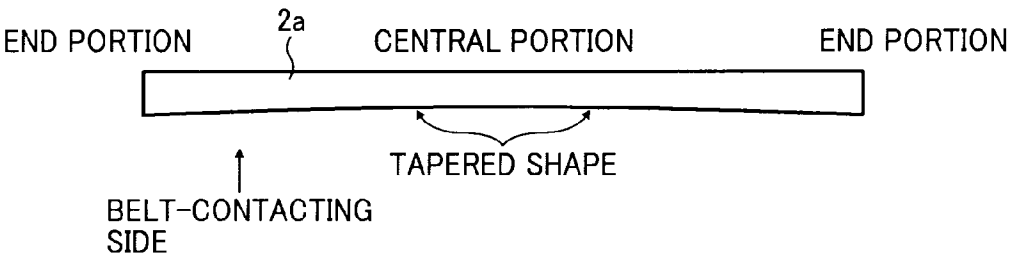
FIG. 7 schematically illustrates a separating member in a fixing device according to this specification.

FIG. 7 schematically illustrates the separating member 2*a* in the longitudinal direction. As illustrated in FIG. 7, a side of the separating member 2*a* which contacts the endless belt 24 (i.e., a belt-contacting side) has a tapered shape such that the separating member 2*a* gradually thickens from the central portion toward the end portions. Thus, the end portions of the separating member 2*a* more presses the endless belt 24 downward than the central portion. At that time, the end portions of the endless belt 24 in the longitudinal direction are positioned below the central portion.

The recording material is less flexible when intimately contacting the endless belt 24, and hard to bend in the direction vertical to the horizontal direction of conveyance. When the separating member 2*a* illustrated in FIG. 7 presses the endless belt 24, the end portions of the endless belt 24 moves downward while the central portion projects upward. Such a projection on the endless belt 24 can easily separate the recording material from the endless belt 24.

The separating member 2*a* may alternatively have another tapered shape such that the separating member 2*a* gradually thickens from the end portions toward the central portion. The separating member 2*a* is required to generate a stress which can deform the recording material in the longitudinal direction.

The separating member 2*a* is horizontally movable along the endless belt 24 between the supporting roller 26 and the heating roller 21, so as to control the position of separation of the recording material from the endless belt 24. In other words, movement of the separating member 2*a* controls the distance and/or time of contact between the recording material and the endless belt 24. A guide member 2*b* is provided below the separating member 2*a* so that the recording material is introduced into a proper feed path after separating from the endless belt 24.

FIG. 5 also shows a relation between the length of contact between the recording material and the endless belt 24 and the image glossiness in the fixing device 50'. As is clear from FIG. 5 that as the length of contact becomes greater, the image glossiness becomes greater, and vice versa. Thus, the image gloss is controllable by controlling the length of contact between the recording material and the endless belt 24.

The fixing device 50' has a similar configuration and operates in a similar manner to that illustrated in FIG. 2, but is different in that the recording material separates from the endless belt 24 by using the separating member 2*a*, not the curvature of the separating roller 27. The separating member 2*a* is movable along the endless belt 24 between the supporting roller 26 and the heating roller 21, so as to control the distance and/or time of contact between the recording material and the endless belt 24. Thus, the resulting image gloss is controllable depending on the type of recording material in use.

Operations of the fixing device 50' illustrated in FIGS. 6A and 6B are described below.

First, operations in a high gloss mode are described.

In the first step (S41), a user inputs the type of recording material in use and the selected gloss mode into an image forming apparatus. Consider a case where the recording material in use is a coated paper having a glossiness of 45%, and a high gloss mode, which targets an image (e.g., a photographic image) having a glossiness of about 70%, is selected. In such a case, the separating member 2*a* is positioned the most nearby the supporting roller 26, as illustrated in FIG. 6A.

In the second step (S42), an unfixed toner image formed on the recording material is conveyed to the fixing nip formed between the heating roller 11 and the pressing roller 12 in the fixing unit 10, and the toner image is fixed on the recording material at a predetermined fixing temperature. The fixing temperature is predetermined based on the type (i.e., thickness) of recording material only for fixing the toner image on the recording material, not for controlling the image gloss. For example, when the predetermined fixing temperature is 160° C., the toner image has a glossiness of about 30% after passing through the fixing nip in the fixing unit 10.

In the third step (S43), the recording material having the fixed toner image thereon is then conveyed to the nip formed between the heating roller 21 and the pressing roller 22 in the glossing unit 20', and the toner image is heated and melted in the nip. For example, the temperature of the heating roller 21 is set to 120° C. After passing through the nip, the toner image still melting is conveyed while intimately contacting the endless belt 24.

In the fourth step (S44), the recording material is conveyed from the nip formed between the heating roller 21 and the pressing roller 22 toward the supporting roller 26 (or the separating member 2*a* at the position illustrated in FIG. 6A), while being cooled by the cooler 28. In the high gloss mode, the length of contact between the recording material and the endless belt 24 is set to maximum, for example, 120 mm, which is equal to the distance between the nip and the supporting roller 26 (or the separating member 2*a* at the position illustrated in FIG. 6A). Therefore, the toner image is consequently cooled to about 60° C. by the cooler 28 when passing by the supporting roller 26. The toner image thus cooled and solidified separates from the endless belt 24, and results in a high-gloss image expressing a glossiness of about 70%.

Next, operations in a normal gloss mode are described.

In the first step (S51), a user inputs the type of recording material in use and the selected gloss mode into an image forming apparatus. Consider a case where the recording material in use is a coated paper having a glossiness of 45%, and a normal gloss mode, which targets an image having a glossiness of about 45%, is selected. In such a case, the separating member 2*a* is positioned as illustrated in FIG. 6B, which is closer (for example, 40 mm) to the heating roller 21 compared to FIG. 6A.

In the second step (S52), an unfixed toner image formed on the recording material is conveyed to the fixing nip formed between the heating roller 11 and the pressing roller 12 in the fixing unit 10, and the toner image is fixed on the recording material at a predetermined fixing temperature of 160° C. The toner image fixed on the recording material has a glossiness of about 30% after passing through the fixing nip in the fixing unit 10.

In the third step (S53), the recording material having the fixed toner image thereon is then conveyed to the nip formed between the heating roller 21 and the pressing roller 22 in the glossing unit 20', and the toner image is heated and melted in the nip. For example, the temperature of the heating roller 21 is set to 120° C. After passing through the nip, the toner image still melting is conveyed while intimately contacting the endless belt 24.

In the fourth step (S54), the recording material is conveyed from the nip formed between the heating roller 21 and the pressing roller 22 toward the separating member 2*a* at the position illustrated in FIG. 6B, while being cooled by the cooler 28. In the normal gloss mode, the length of contact between the recording material and the endless belt 24 is set to, for example, 80 mm, which is equal to the distance between the nip and the separating member 2*a* at the position illustrated in FIG. 6B. Therefore, the toner image is consequently cooled to about 90° C. by the cooler 28 when passing by the separating member 2*a* at the position illustrated in FIG. 6B. The toner image thus cooled separates from the endless belt 24, and results in an image expressing a glossiness of about 45%.

Next, operations in a low gloss mode are described.

In the first step (S61), a user inputs the type of recording material in use and the selected gloss mode into an image forming apparatus. Consider a case where the recording material in use is a normal paper having a glossiness of 10% or a coated paper having a glossiness of 45%, and a low gloss mode, which targets a low-gloss image, is selected. In such a case, the separating member 2*a* is positioned much closer to the heating roller 21 compared to FIG. 6B. Preferably, the cooler 28 is also moved depending on the position of the separating member 2*a*.

In the second step (S62), an unfixed toner image formed on the recording material is conveyed to the fixing nip formed between the heating roller 11 and the pressing roller 12 in the fixing unit 10, and the toner image is fixed on the recording material at a predetermined fixing temperature.

In the third step (S63), the recording material having the fixed toner image thereon is then conveyed to the nip formed between the heating roller 21 and the pressing roller 22 in the glossing unit 20', and the toner image is heated and melted in the nip. After passing through the nip, the toner image still melting is conveyed while intimately contacting the endless belt 24.

In the fourth step (S64), the recording material is conveyed from the nip formed between the heating roller 21 and the pressing roller 22 toward the separating member 2*a*, while being cooled by the cooler 28. In the low gloss mode, the length of contact between the recording material and the endless belt 24 is set equal to the distance between the nip and the separating member 2*a*. Therefore, the toner image is consequently cooled to some extent by the cooler 28 when passing by the separating member 2*a*. The toner image thus cooled separates from the endless belt 24, and results in a low-gloss image.

When glossing the toner image in the glossing unit 20', the surface temperature of the heating roller 21 and the nip pressure between the heating roller 21 and the pressing roller 22 may be controlled depending on the gloss mode selected. Thus, the toner image receives appropriate amounts of heat and pressure to level the surface thereof.

There may be a case where a toner image is formed on an A3-size recording material having a basis weight of 80 g/m$^2$ or less (e.g., a thin paper), which does not need glossing. It is likely that such a thin recording material gets wrinkled when subjected to deflection and stretching due to a difference in linear speed between the fixing unit 10 and the glossing unit 20'. To solve such a problem, it is preferable that the pressing roller 22 is more detached from the heating roller 21 (or the endless belt 24). For example, the distance between the heating roller 21 (or the endless belt 24) and the pressing roller 22 is preferably 2 mm or less, within which the recording material can normally pass through the nip. Because the toner image may partially contact the endless belt 24 in such cases, the endless belt 24 preferably has a release layer comprised of a fluorine-containing resin on its surface, so as not to degrade the toner image.

As seen above, the fixing device 50' can control the length of contact and/or time between the recording material and the endless belt 24 by moving the separation member 2*a*. Therefore, the fixing device 50' can control the resulting image gloss depending on the type of recording material in use. The separation member 2*a* requires only a small space for moving, which contributes to downsizing of the fixing device 50'.

Figure 8:
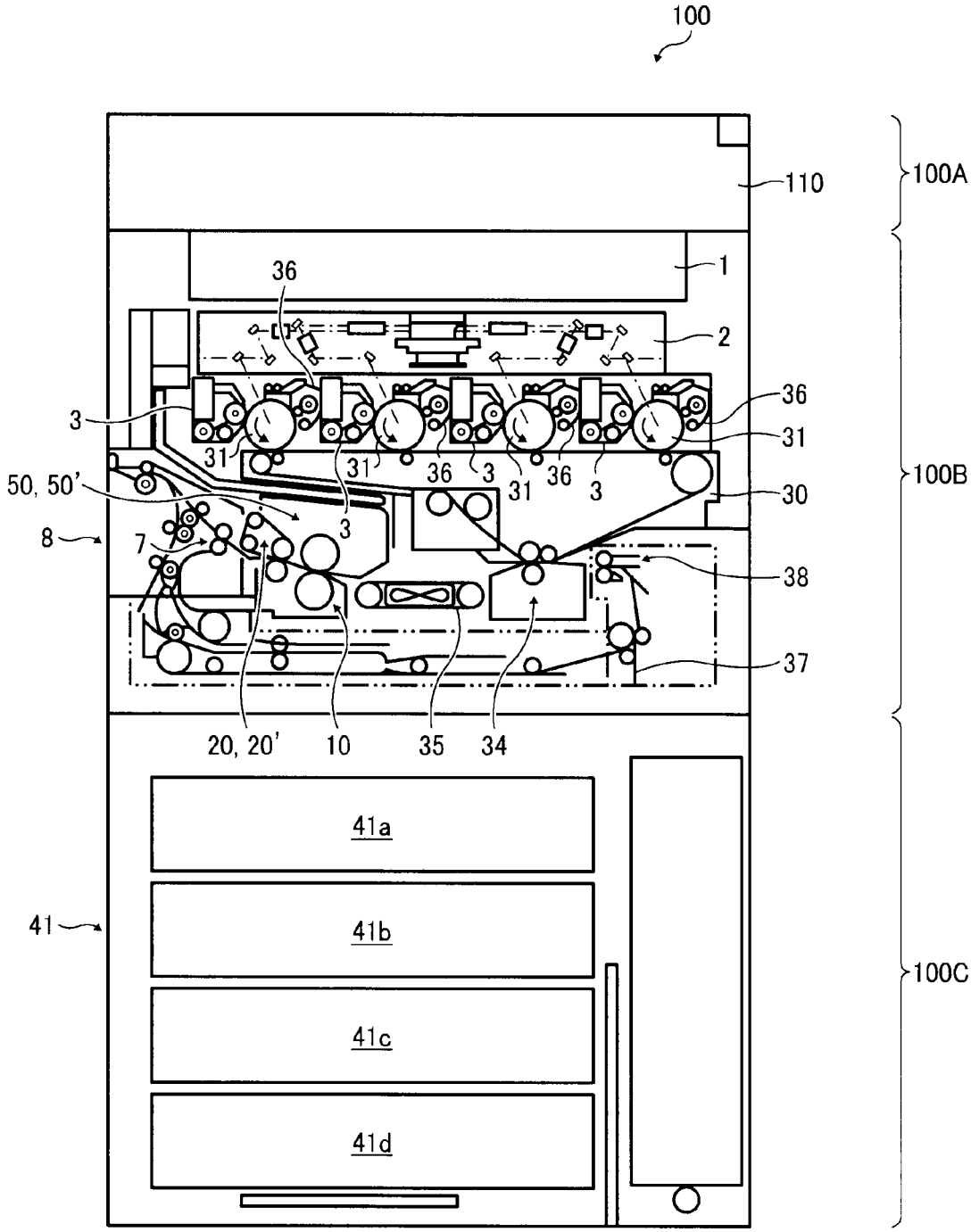
FIG. 8 schematically illustrates an exemplary embodiment of an image forming apparatus according to this specification.

FIG. 8 schematically illustrates an exemplary embodiment of an image forming apparatus according to this specification. An image forming apparatus 100 illustrated in FIG. 8 is a digital color copier.

The image forming apparatus 100 includes an image reading part 100A on an upper part, an image forming part 100B on a central part, and a paper feed part 100C on a lower part.

The image reading part 100A includes a scanner 1 that optically reads image information of a document and an automatic document feeder (ADF) 110 that continuously feeds documents to the scanner 1.

The image forming part 100B includes an intermediate transfer member 30, which is a belt-shaped member having a transfer surface stretching in a horizontal direction. Four photoreceptors 31 are arranged above the intermediate transfer member 30 so as to face the transfer surface of the intermediate transfer member 30. The photoreceptors 31 each bear respective toner images of complementary colors (i.e., yellow, magenta, cyan, and black) of the separated colors.

A writing unit 2 is provided above the photoreceptors 31. The writing unit 2 emits light onto each of the circumferential surfaces of the photoreceptors 31 based on the scanned or input image information. The photoreceptors 31 have a drum-like shape and rotate in the same direction, e.g., counterclockwise in FIG. 8. Around each of the photoreceptors 31, a charger, a developing device 3, a primary transfer member, and a cleaner 36 are provided. The cleaner 36 collects residual toner particles remaining on the photoreceptor 31 after transferring a toner image onto the intermediate transfer member 30. Each of the developing devices 3 contains a different-color toner.

The intermediate transfer member 30 is stretched taut with multiple driving or driven rollers. The intermediate transfer member 30 and each of the photoreceptors 31 move in the same direction at their facing position. A secondary transfer member 34 is provided so as to face one of the driven rollers, forming a secondary transfer nip. Further, a conveyance belt 35, the above-described fixing device 50 or 50' including the fixing unit 10 and the glossing unit 20 or 20', and a pair of feed rollers 7 are provided along the paper peed path in this order.

The paper feed part 100C includes paper feed trays 41*a*, 41*b*, 41*c*, and 41*d* (collectively "41") each store sheets of a recording material, a paper feed path 37, and a registration member 38. The top sheet of the recording material stored in the paper feed trays 41 is fed to the secondary transfer nip via the paper feed path 37. The registration member 38 feeds the sheet to the secondary transfer nip in synchronization with an entry of a toner image into the secondary transfer nip, while correcting skews.

Image forming operations in the image forming apparatus 100 are described below. First, the charger uniformly charges a surface of the photoreceptor 31. The writing unit 2 then forms an electrostatic latent image on the charged surface of the photoreceptor 31 based on the scanned or input image information. The developing device 3 develops the electrostatic latent image into a toner image. The toner image is then primarily transferred onto the intermediate transfer member 30 by the primary transfer member to which a predetermined bias is applied. Different-color toner images thus formed on the respective photoreceptors 31 are sequentially and electrostatically transferred onto the intermediate transfer member 30, forming a composite toner image.

The composite toner image is then fed to the secondary transfer nip, and transferred onto the recording material by the secondary transfer member 34. The recording material having the composite toner image thereon is fed to the fixing device 50 or 50' so that the composite toner image is fixed on the recording material in the fixing unit 10, followed by optional glossing in the glossing unit 20 or 20'. The resultant image is finally fed to a discharge part 8 by the pair of feed rollers 7, and discharged from the image forming apparatus 100.

The image forming apparatus 100 is capable of reliably fixing toner images on a wide variety of recording materials (e.g., a thin paper, a thick paper) with or without glossing the toner images.

Additional modifications and variations of the present invention are possible in light of the above teachings. It is therefore to be understood that within the scope of the appended claims the invention may be practiced other than as specifically described herein.

Figure 9:
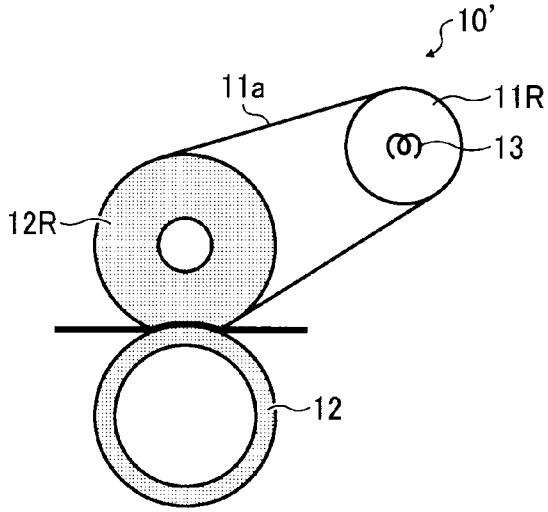
FIGS. 9 to 11 schematically illustrate exemplary embodiments of a fixing unit in a fixing device according to this specification.

For example, the fixing unit 10 in the fixing device 50 or 50', illustrated in FIG. 4, 6A, or 6B, may be replaced with another fixing unit as illustrated in FIG. 9.

FIG. 9 schematically illustrates another exemplary embodiment of a fixing unit according to this specification. A fixing unit 10' illustrated in FIG. 9 includes a fixing belt 11*a* stretched taut with a heating roller 11R and a fixing roller 12R, in place of the heating roller 11 in FIGS. 4, 6A, and 6B. A pressing roller 12 is pressed against the fixing roller 12R with the fixing belt 11*a* therebetween, thus forming a fixing nip. A halogen heater 13 heats the fixing belt 11*a*.

Figure 10:
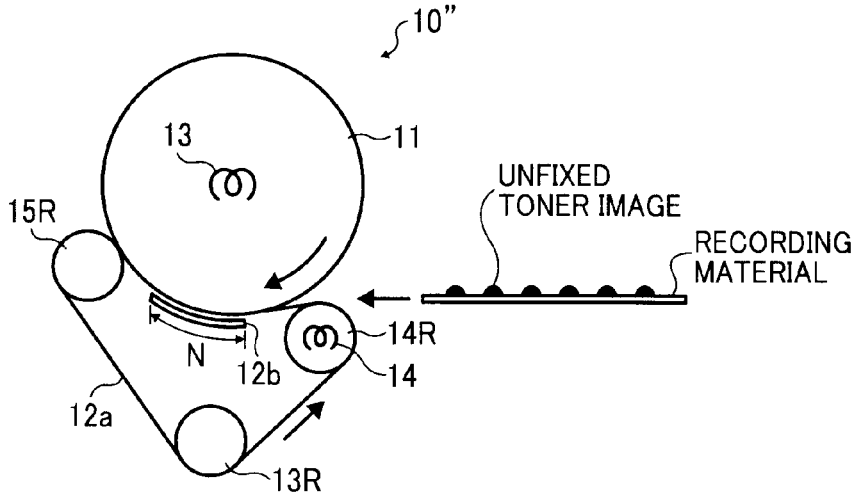
Figure 11:
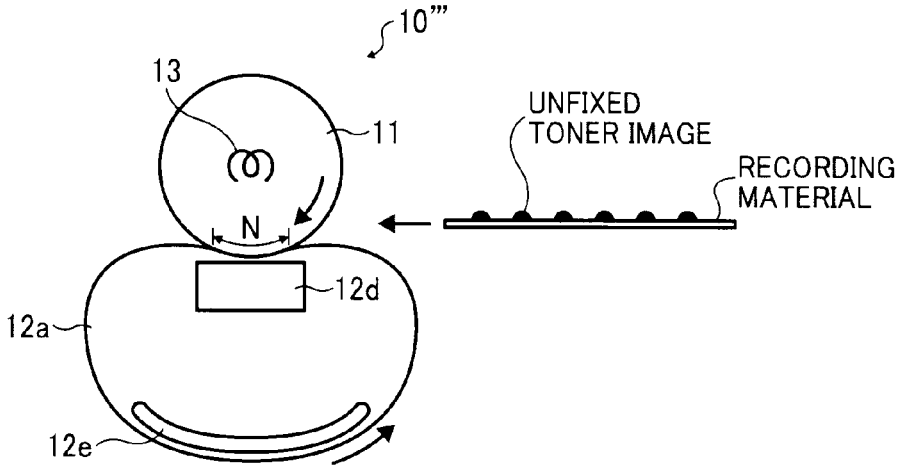

Alternatively, the fixing unit 10 in the fixing device 50 or 50', illustrated in FIG. 4, 6A, or 6B, may be replaced with another fixing units as illustrated in FIG. 10 or FIG. 11.

FIG. 10 schematically illustrates another exemplary embodiment of a fixing unit according to this specification. A fixing unit 10" illustrated in FIG. 10 includes a heating roller 11 and a pressing belt 12*a* stretched with multiple rollers 13R, 14R, and 15R. A backup member 12*b* is pressed against the heating roller 11 with the pressing belt 12*a* therebetween, thus forming a fixing nip N. Halogen heaters 13 and 14 heat the heating roller 11 and the pressing belt 12*a*, respectively.

FIG. 11 schematically illustrates another exemplary embodiment of a fixing unit according to this specification. A fixing unit 10''' illustrated in FIG. 11 includes a heating roller 11 and a pressing belt 12*a* supported with a supporting member 12*e* being free of tension. A backup member 12*d* is pressed against the heating roller 11 with the pressing belt 12*a* therebetween, thus forming a fixing nip N. A halogen heater 13 heats the fixing belt 11*a*.

What is claimed is:

1. A fixing device, comprising:

a fixing unit that fixes a toner image on a recording material by application of heat and pressure; and a glossing unit that controls a gloss of the toner image fixed on the recording material, the glossing unit disposed downstream from the fixing unit relative to a direction of conveyance of the recording material, and the glossing unit including:

a heating roller, an endless belt stretched taut over multiple rollers including the heating roller, a pressing roller pressed against the heating roller with the endless belt therebetween to form a nip therebetween, and a separating member that separates the recording material from the endless belt downstream from the nip, wherein the multiple rollers are positioned to maintain the recording material in contact with the endless belt for a predetermined distance downstream from the nip in the direction of conveyance of the recording material, and wherein the separating member is movable along the endless belt downstream from the nip in the direction of conveyance of the recording material, to control a length of contact between the recording material and the endless belt.

2. The fixing device according to claim 1, wherein the separating member is a claw member provided facing an outer circumferential surface of the endless belt.

3. The fixing device according to claim 1, wherein the separating member is a pressing member provided facing an inner circumferential surface of the endless belt to press a part of the endless belt outward.

4. The fixing device according to claim 3, wherein a portion of the pressing member which presses the endless belt has a tapered shape in a width direction.

5. The fixing device according to claim 4, wherein the pressing member has the tapered shape such that both ends of the endless belt in the width direction are pressed downward.

6. The fixing device according to claim 1, wherein the glossing unit further includes a cooler that cools the endless belt for the predetermined distance downstream from the nip in the direction of conveyance of the recording material.

7. The fixing device according to claim 1, wherein the recording material separates from the endless belt after the fixing device cools the toner image below a glass transition temperature of the toner.

8. An image forming apparatus, comprising:

an image forming unit that forms a toner image on a recording material; and the fixing device according to claim 1.

9. The fixing device according to claim 1, wherein the separating member is movable in a range between a first position adjacent to the nip and a second position adjacent a separating roller of the glossing unit.

10. The fixing device according to claim 1, wherein the separating member is horizontally movable between the nip and a separating roller of the glossing unit.

11. The fixing device according to claim 1, wherein a leading edge of the separating member gets between the endless belt and the recording material in contact with the endless belt.

* * * * *